US006053550A

United States Patent [19]

Paterson

[11] Patent Number: 6,053,550

[45] Date of Patent: Apr. 25, 2000

[54] DEVICE FOR GRIPPING AND SUPPORTING ARTICLES

[76] Inventor: Bruce Paterson, 11942 Auburn Rd., Chardon, Ohio 44024

[21] Appl. No.: 09/073,689

[22] Filed: May 6, 1998

Related U.S. Application Data

[60] Provisional application No. 60/045,661, May 7, 1997.

[51] Int. Cl.[7] ..... B66C 1/28

[52] U.S. Cl. ..... 294/81.56; 294/81.51

[58] Field of Search ..... 294/81.1, 81.2, 294/81.51, 81.56, 81.61, 82.13, 67.3, 67.31, 87.1, 110.1, 81.5

[56] References Cited

U.S. PATENT DOCUMENTS

| | | | |
|---|---|---|---|
| 2,119,547 | 6/1938 | Knerr | 294/81.2 |
| 2,360,740 | 10/1944 | Sturdy | 294/67.31 |
| 2,669,479 | 2/1954 | Louckes | 294/81.51 |
| 2,901,311 | 9/1959 | Reel | 294/81.61 |
| 3,220,760 | 11/1965 | Buchik et al. | 294/81.61 |
| 4,462,627 | 7/1984 | Kudlicka . | |
| 4,486,120 | 12/1984 | Landry, Jr. | 294/81.51 |
| 4,563,031 | 1/1986 | Kishimoto et al. | 294/81.51 |
| 5,350,210 | 9/1994 | Barnett et al. . | |
| 5,820,184 | 10/1998 | Echenay | 294/81.56 |

FOREIGN PATENT DOCUMENTS

| | | | |
|---|---|---|---|
| 257-817 | 6/1988 | Germany | 294/87.1 |

*Primary Examiner*—Dean J. Kramer

*Attorney, Agent, or Firm*—Fay, Sharpe, Fagan, Minnich & McKee LLP

[57] ABSTRACT

An improved lifting apparatus is provided for lifting joist sections to facilitate placement in a building structure. The apparatus includes a structural frame that is secured to a beam lifted by an erection crane. Plural grasping members such as a series of hooks extend outwardly from the frame and are disposed on opposite sides of the beam for simultaneously gripping and releasing the individual joist members that comprise the joist section. The hooks are urged by a biasing spring toward one of a release and gripping positions and a locking assembly cooperates with the individual hooks to prevent inadvertent movement of the hooks.

17 Claims, 9 Drawing Sheets

DEVICE FOR GRIPPING AND SUPPORTING ARTICLES

This application claims the benefit of US provisional application Ser. No. 60/045,661, filed May 7, 1997.

The present invention relates generally to devices for gripping and supporting articles. Specifically, the invention relates to building construction and hoist-line implements or attachments for gripping and supporting articles, such as joist sections.

BACKGROUND OF THE INVENTION

In the field of heavy construction, including the construction of steel frameworks for buildings, large assembled structures are typically hoisted into place by a crane. Referring to prior art FIG. 1, the construction site 10 of a typical building includes a building grid 12 having a number of regularly spaced positions at which steel girders are installed. Construction of the building proceeds with the installation of vertical columns 18 in these regularly spaced positions and bays 14. The bays 14 comprise a line beam 16 that extends in a horizontal orientation on top of the vertically oriented columns 18. Tie joists 20 extend generally perpendicular to the line beams to provide further support to the vertical columns 18. Each bay 14 provides the underlying support structure for a joist 24 which will support a particular floor of the building.

The joists 24 are delivered in bundles to the construction site 10 and are assembled into joist sections 28 on a joist table 26 which provides an aid to workers in spacing and assembly. A crane 22—which is disposed on or near the construction site and, usually, within the building structure itself—is used to hoist the joist sections 24 to a position on top of the line beams 16.

Referring additionally to prior art FIG. 2, each joist section 28 includes a plurality of joists 24 which are spaced apart from one another using an X-bracing 30 which is bolted thereto and/or using welded bridging rows 32 which are welded thereto. The joists 24 extend in a parallel fashion and include joist ends 44 to provide support to the joist section 28 as it rests on the line beams 16.

As shown in FIG. 2, known methods and devices for hoisting the joist section 28 comprise a rigging 34 which includes a hoist cable 36 provided with a hook and ball assembly 38 connected to a hoist beam 40. A plurality of joist cables 42 extend from the hoist beam 40 and are attached to the joist ends 44. After the joist section 28 has been assembled on the joist table 26, the rigging 34 is attached to the joist section by workers who must attach a separate joist cable 42 to each of the joist ends 44. After the device has been lifted and put in place, workers—who are positioned on top of the line beams 16—must walk along and detach each of the joist cables 42 from the joist ends 44. Typically, two workers on top of the line beams walk along the beams unhooking the attached cables and gathering them together. Usually, a manila line will be used to hold the ends of the cables in a group or bunch. As the crane lifts the cable ends to clear the structure, the manila line will be used to play out or guide the cable ends to prevent them from falling in the joist structure as the crane lifts the assembly to clear the top of the building.

The aforementioned known methods and devices for attaching the hoist-line to the joist section present a number of problems. One problem is that these known methods and devices expose workers to hazards inasmuch as detachment of the joist cables from the joist ends is required at dangerous heights from the ground. Another problem is that the prior art methods and devices for detaching the cables and attaching the cables is cumbersome and requires a great deal of effort and time to detach the cables individually and to manage the detached cables so that they do not tangle in the joists when the crane lifts the hoist-line in order to clear the building top. There is thus a need for a device which solves the aforementioned problems.

SUMMARY OF THE INVENTION

The present invention contemplates a new and improved apparatus and method of gripping and supporting joist section to facilitate placement of the joist sections in a building structure in a safe, efficient manner.

According to one aspect of the invention, the apparatus includes a structural frame selectively secured to an erection crane. Plural grasping members are spaced along the structural frame for grasping and releasing the spaced joist members or joist section. An actuating assembly simultaneously moves the gripping members between gripping and releasing positions.

According to another aspect of the invention, the grasping members are hooks dimensioned for receipt about the joist members.

According to a further aspect of the invention, the hooks are disposed in opposite directions on opposite sides of the structural frame.

According to a still further aspect of the invention, the hooks are urged to one of closed and open positions.

A principal advantage of this invention is to provide a device which facilitates detachment of a hoist-line from a joist section.

Another advantage of the invention resides in the expedited installation of a joist section by providing an apparatus which is capable of quickly gripping the joist section and quickly releasing it when it has been installed in place.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in the specification illustrated in the accompanying drawings which form a part hereof, wherein.

DETAILED DESCRIPTION OF THE PREFERRED EMBODIMENTS

Figure 3:
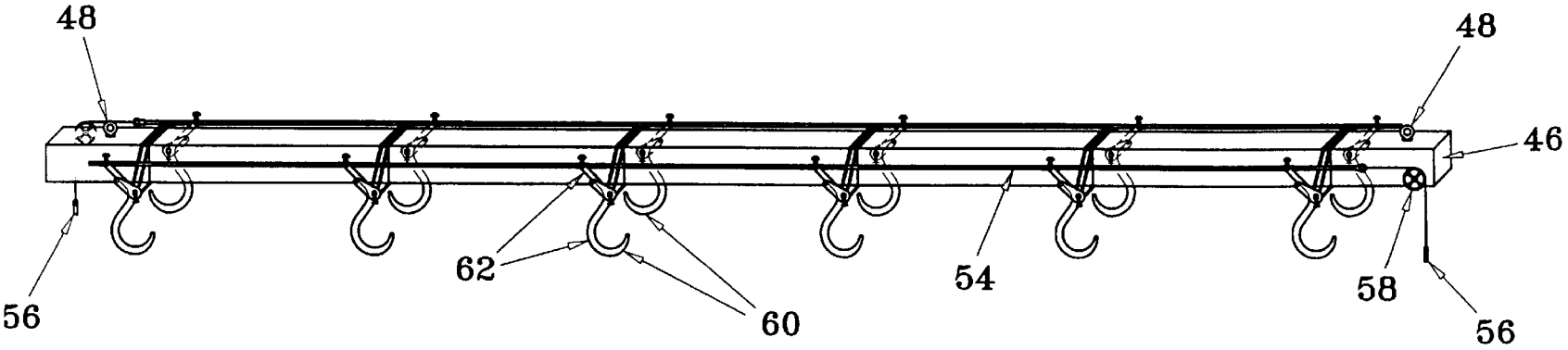
FIG. 3 is an illustration of a first preferred embodiment of the invention.

Referring now to the drawings wherein the showings are for the purposes of illustrating the preferred embodiments of the invention only and not for purposes of limiting the same, the FIGURES show a gripping assembly which is capable of simultaneously uncoupling from the joist section. Referring to FIG. 3, a joist hoist beam 46 is provided as an elongate tube section which is rectangular in cross-section comprising, for example, a steel tube. The joist hoist beam 46 is provided with cable attachment eyelets 48 for permitting the attachment of a spreader cable thereto. The eyelets may be positioned at various locations along the beam but are generally disposed adjacent opposite ends of the beam.

Situated on the joist hoist beam 46 are a plurality of gripper assemblies 50 which may be adjusted along the longitudinal extent of the beam by sliding the gripper assemblies therealong and securing them at the desired location by means of a fastener such as a pinch bolt. Each gripper assembly includes a pair of grippers 60 or hooks that are pivotally mounted thereto. Grippers 60 include actuating arms 62 which are cooperatively linked to an actuating rod 54. The rod 54 is connected to an actuating cable 52 which has a weight 56 connected thereto and is situated over a pulley member or sheave 58. The actuating rod 54, actuating cable 52, weight 56 and pulley 58 are preferably provided on both sides of the joist hoist beam 46.

Figure 4A:
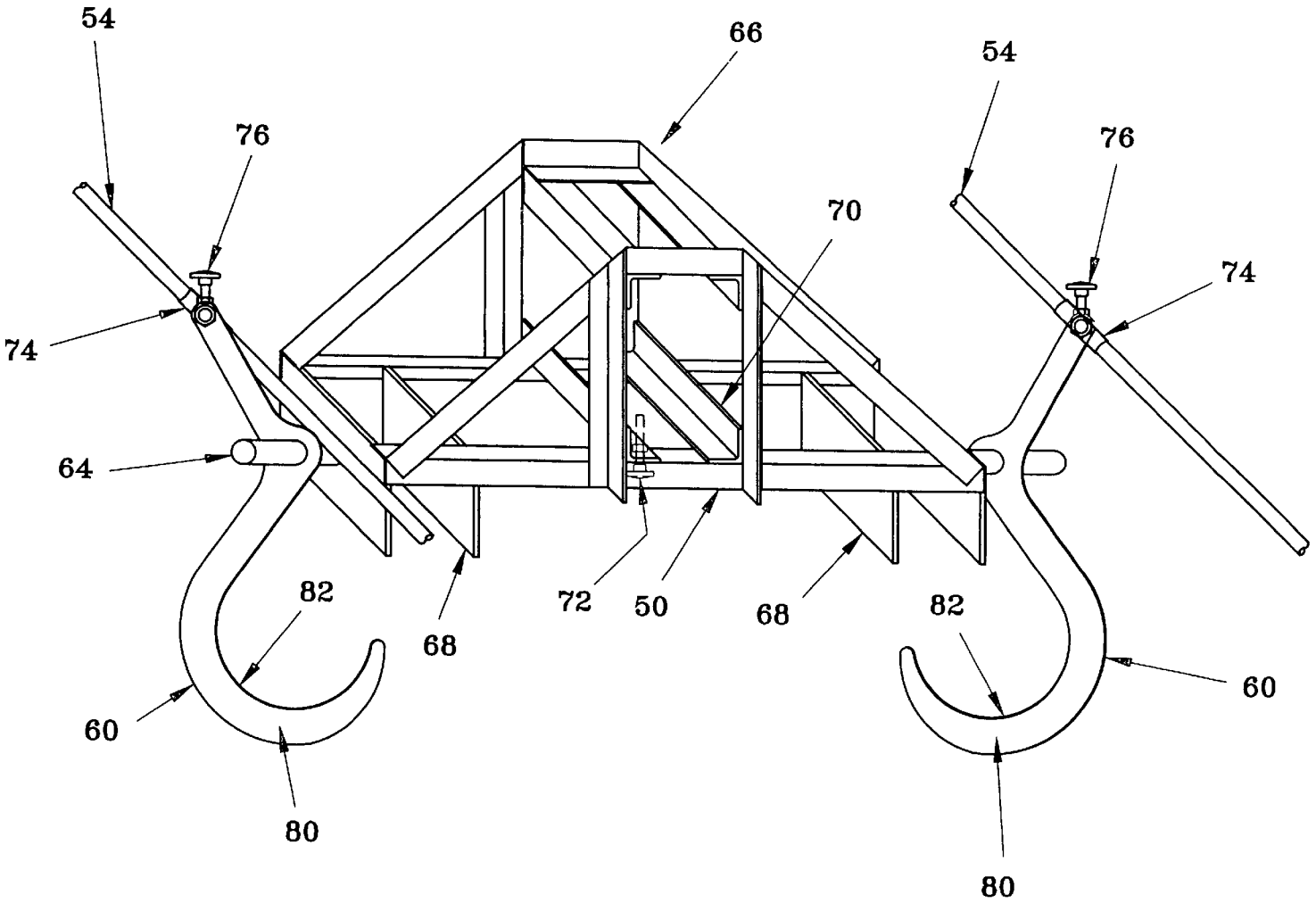
FIGS. 4A and 4B are illustrations of an adjustable gripping assembly according to the first preferred embodiment of the present invention.

The gripper assemblies 50 are illustrated in more detail in FIG. 4A. The assembly comprises a structural frame or bracket 66 which includes flanges 68 that support pivot pins 64. The structural frame has a central rectangular opening that conforms to the periphery of the beam. For example, structural members such as angles are secured together and mount the grippers on opposite sides of the beam. As can be seen from FIG. 4A, bracket 66 is preferably symmetrical about a centerline. Grippers 60 are mounted for pivotal movement about horizontal axes on the pivot pins 64 and include actuating arms 62 extending therefrom.

At the end of actuating arms 62 is provided an actuation arm fastening sleeve 74 which comprises a collar or pipe nipple situated around the actuating rod 54. The actuating arm 62 is pivotally connected to the sleeve 74 which is also provided with a pinch bolt 76 in order to lock its position on actuating rod 54.

Bracket 66 also includes bearing surfaces 70 which may be comprised of angle iron that is situated to provide a complementary shape to the cross-section of the joist hoist beam 46 (not shown in FIG. 4A). Thus, the bracket 66 is provided with bearing surfaces 70 for sliding movement along the length of joist hoist beam 46. A gripper assembly pinch bolt 72 is provided on the bracket 66 in order to lock the position of the gripper assemblies 50 on the joist hoist beam 46.

Figure 4B:
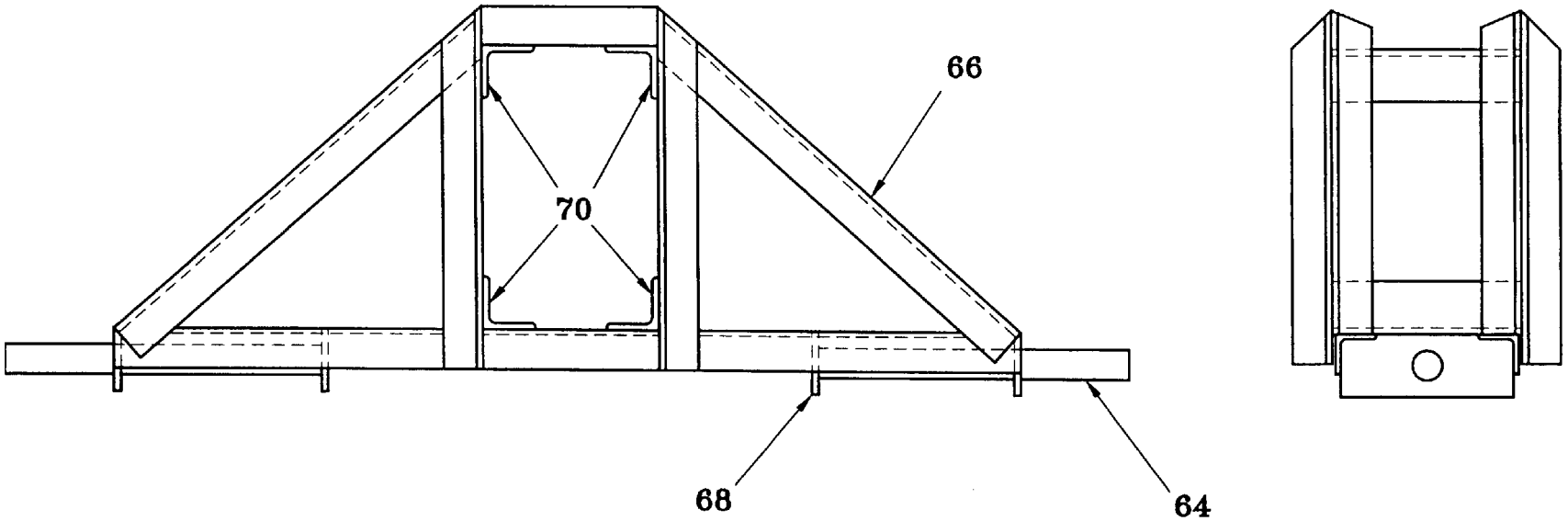

FIG. 4B further illustrates the dimensions of bracket 66 in a preferred embodiment of the invention. It will be recognized that on each bracket 66 there is provided two gripping members 60 that are actuatable in opposite directions. Therefore, the actuating rods 54 move in opposite directions with respect to the joist hoist beam 46 in moving the grippers 60 from the coupled to the uncoupled positions.

It is to be appreciated that in order to couple the gripping assembly to a joist section, the crane is used to lower the assembly into close proximity to the joist section. A worker then manipulates the hanging weight to move the actuating rod 54 to rotate the grippers 60 to an uncoupled position. The device is then further lowered so that the hooks of the grippers are aligned with the joists. The weight is then manipulated to allow the grippers to rotate back to a coupled position.

Alternatively, the device could be configured so that as it is lowered, the grippers slightly rotate to an uncoupled position as contact is made with the joist. The grippers would then effectively slide over and hook under the joist to couple itself thereto. The hooking action in this arrangement is caused by the hanging weight.

When the crane lifts the device, the grippers forcefully engage the joists. The geometry and arrangement of the device keep the grippers 50 coupled to the joists by the force of gravity on the joist section as the section is lifted.

Figure 1:
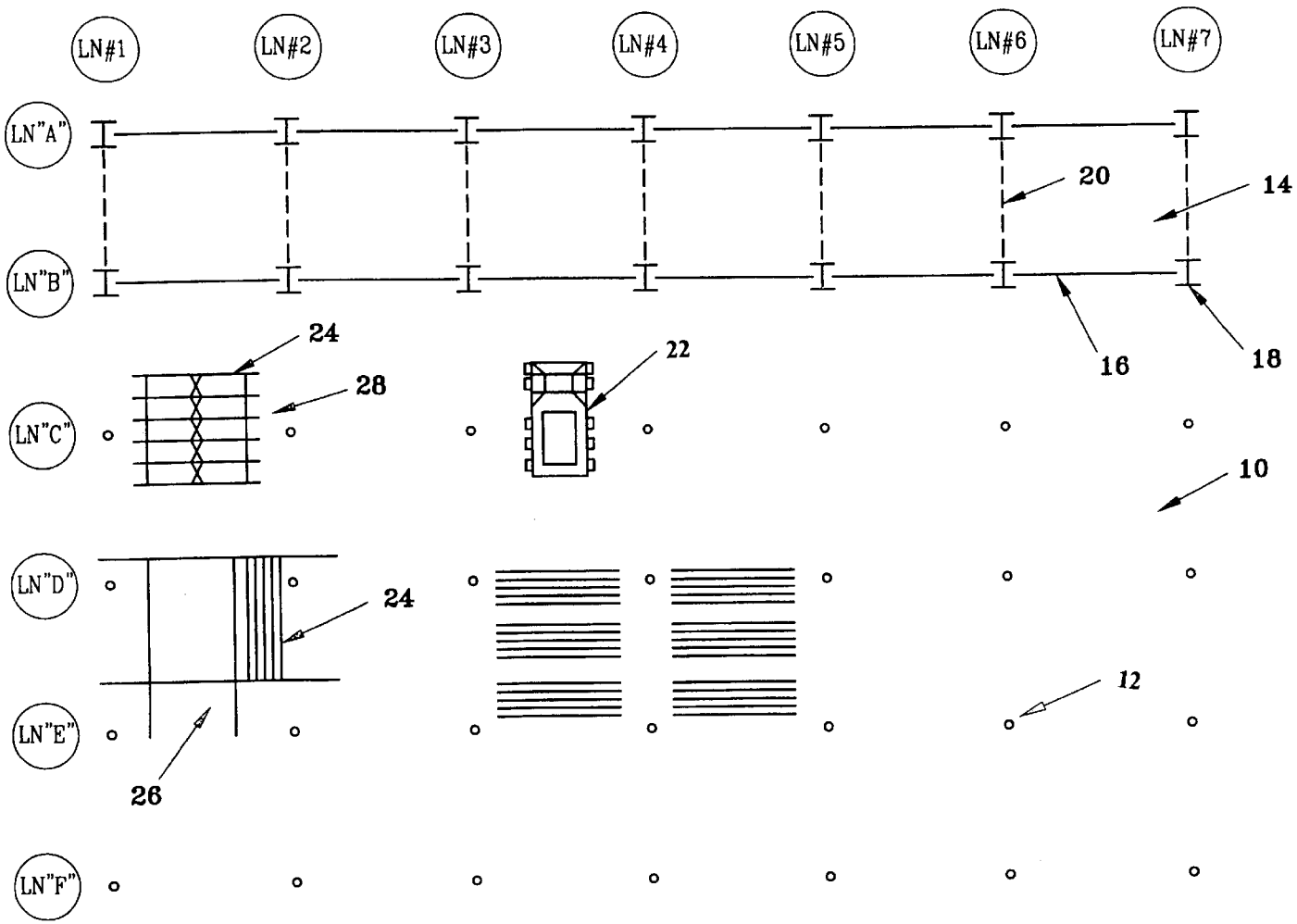
FIG. 1 PRIOR ART
FIGS. 1 and 2 illustrate prior art hoist riggings as described above.
Figure 2:
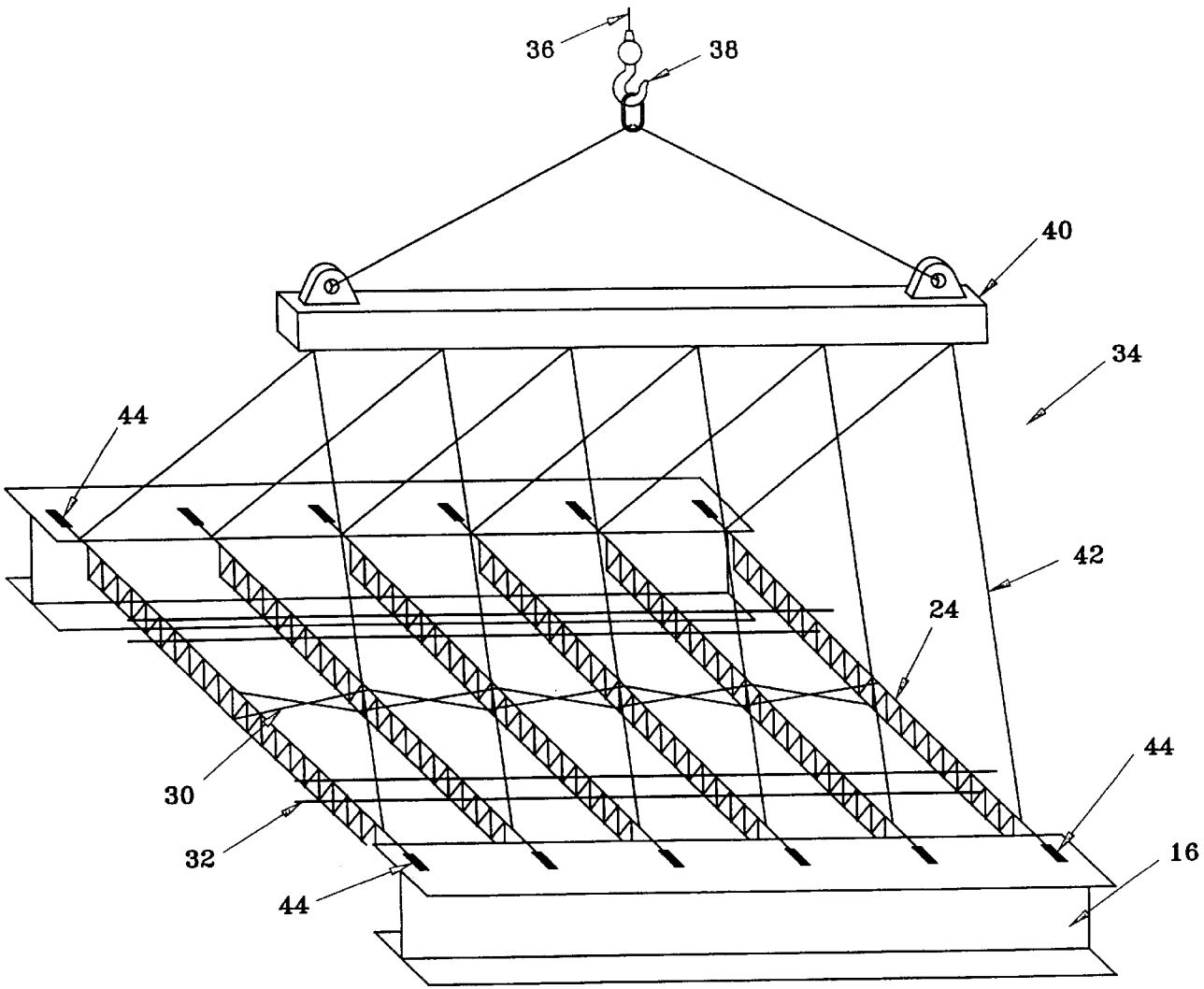
FIG.2 PRIOR ART
Figure 5:
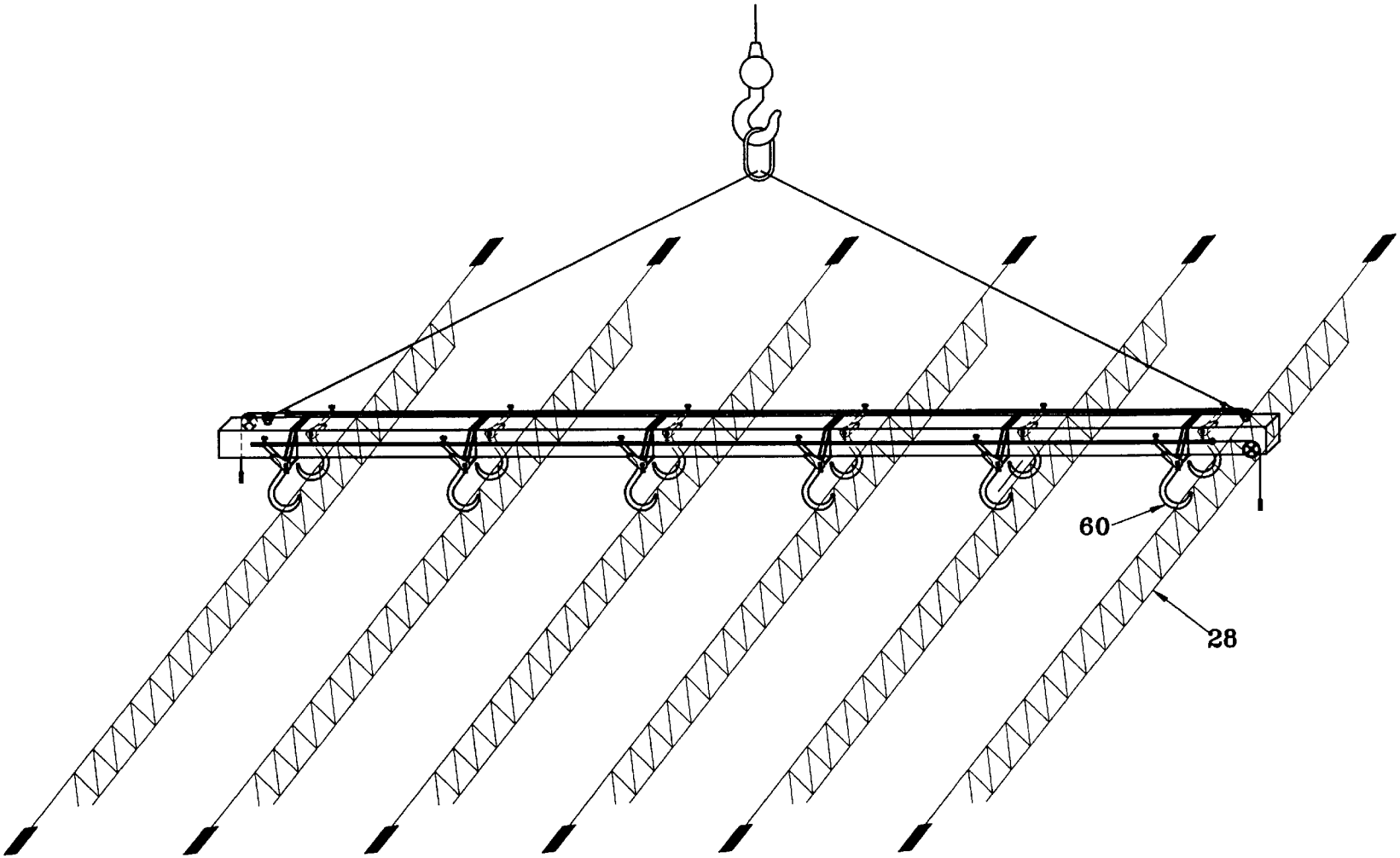
FIG. 5 is an illustration of the first preferred embodiment of the present invention used in lifting a joist section.

FIG. 5 illustrates the coupled arrangement of the gripping device according to the present invention. In this arrangement, a hoist-line is connected to a joist section 28 as described above and the joist section 28 is lifted into position on the line beams 16 (FIG. 1). As shown, gripping members 60 are illustrated in the coupled position, i.e., the position in which they are rotated to their full downward extent. Each gripper is engaged with a joist of the joist section.

Figure 6:
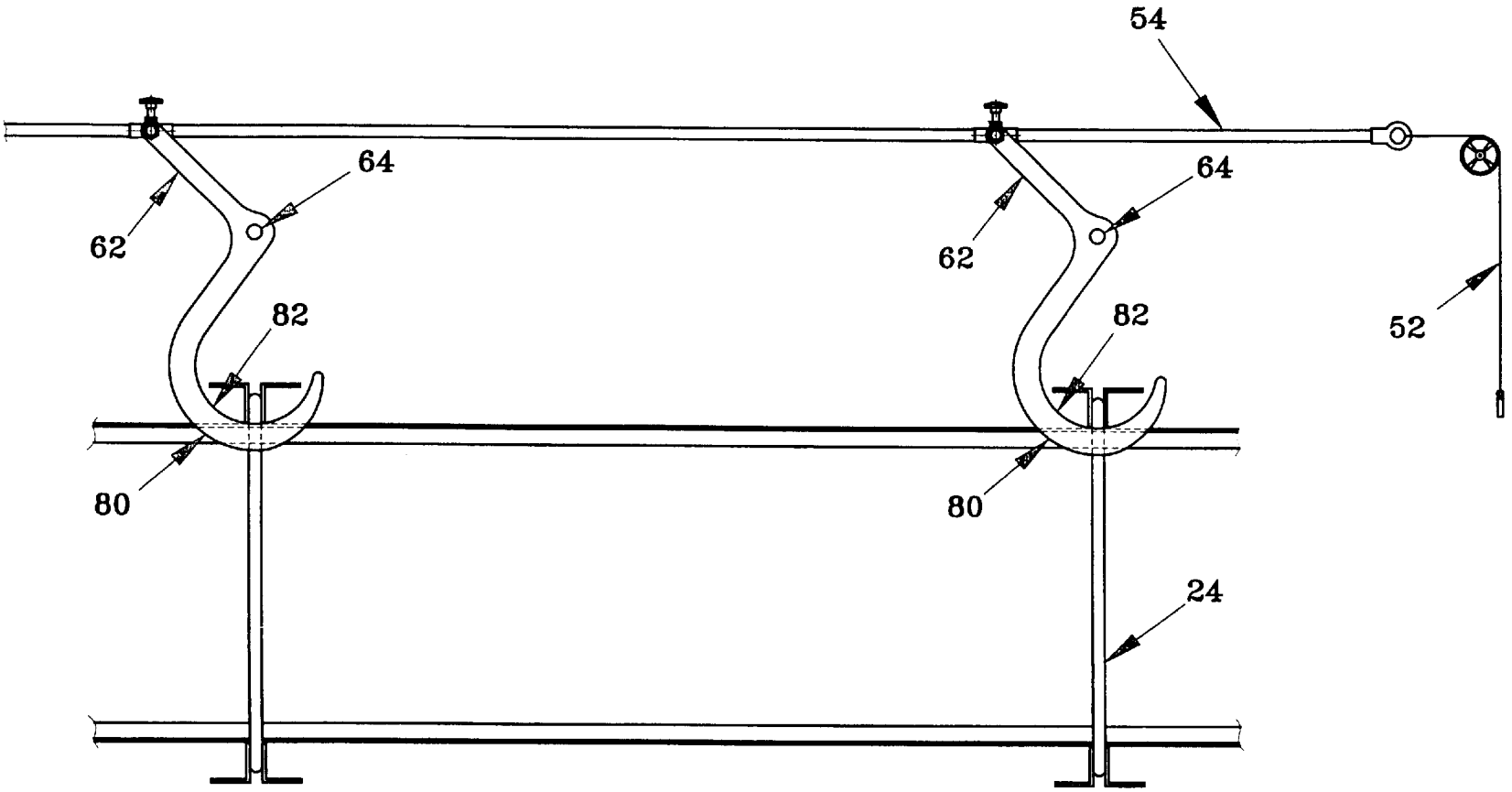
FIG. 6 is an illustration of a linkage for gripping hooks according to a preferred embodiment of the present invention.

This is illustrated in more detail in FIG. 6 where it can be seen that the rounded inner surface 82 of the gripper hook 80 engages an upper member of a joist 24. The gripping hooks 80 are shown in the coupled position in which they are rotated to their full counter-clockwise position as shown in that FIGURE.

It is to be appreciated that the geometry of the gripping hook, the arrangement of the pivot point and actuating arm, and connection of the arm to the actuating rod allow the gripping hooks to uncouple the joists when the joist section is positioned on the line beams 16. In this regard, when the joist section is resting on the line beams, the hoist-line is slackened and the gripping members no longer bear the weight of the joist section 24. The gravitational force of hanging weight 56 is then transmitted to the actuating arms 62 via the actuating rod 54 which causes rotation of the gripping hooks 80 in a clockwise direction to an uncoupled position. The hooks 80 are then disengaged from the joist 24. An identical (but opposite) action is experienced on the opposite side of the bracket 66 (not shown) and those hooks are also simultaneously uncoupled. The assembly may then be removed from the vicinity of the joist section 28 by movement in a vertical direction by the crane.

Figure 7:
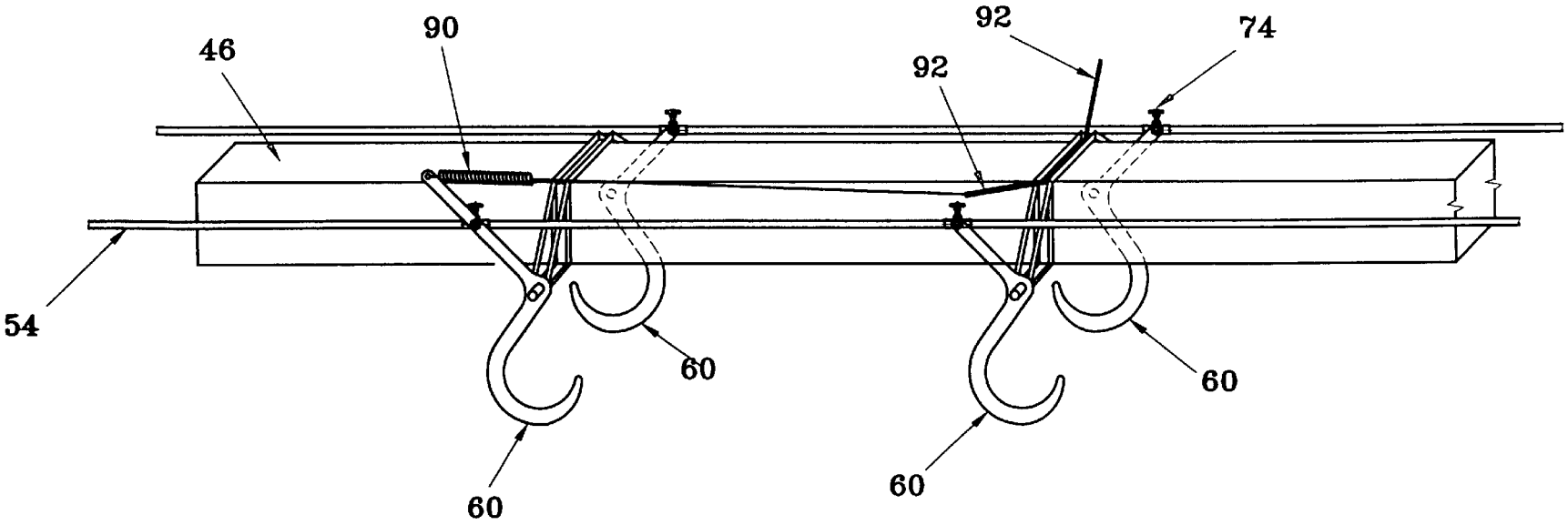
FIG. 7 is a perspective view of a second preferred embodiment of the invention, and particularly a biasing assembly for urging the gripping assembly toward a gripping position.

With reference now to FIG. 7, an alternative biasing assembly is illustrated. Particularly, the actuating rod interconnects all of the gripper assemblies on one side of the beam as described above. The actuating arm of one of the gripper assemblies is connected to a biasing member such as one end of spring 90 while the other end of the spring is secured to a spring arm 92 that extends outwardly, for example, from an adjacent gripper assembly. The desired biasing force imposed on the grippers may be altered by changing the tension on the spring, e.g., altering the length of the spring relative to the arm 92. In this manner, all of the grippers on one side of the beam can be simultaneously urged toward an open or closed position as desired.

It will also be understood that the grippers on the other side of the beam can be connected to a biasing member on the far side of the beam in much the same manner.

Figure 8:
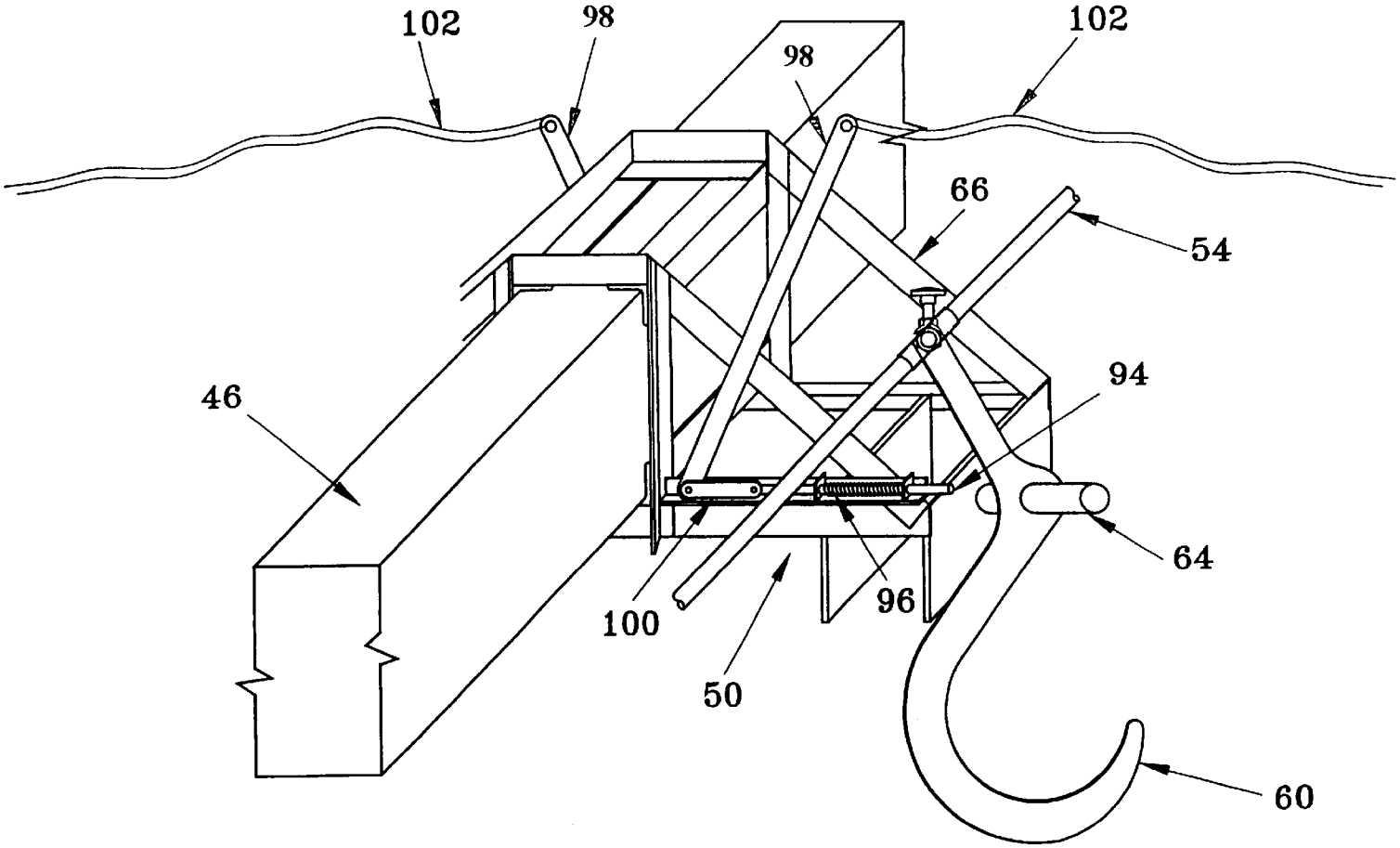
FIG. 8 is a perspective view of an interlock assembly for maintaining the gripping assembly in the gripping position.

FIG. 8 shows a further modification to the assembly that allows an additional locking feature to be incorporated therein. a pin 94 is biased by a spring 96 into the rotational path of the grippers. Preventing rotation of one gripper limits rotation of all of the grippers on one side of the beam since all of the grippers are interconnected by the actuating rod 54. It is preferred that the pin be urged into an interference position with the rotational path of the gripper and that a positive action must be taken on behalf of the workers to change the position of the grippers. This is accomplished via the linkages 98, 100 pinned together at one end. The outer end of linkage 98 includes a rope or line 102 that extends to the worker who is working on one side of the beam on a line beam. A similar line 102 extends to the second worker on the other side of the beam. By pulling on the line, grippers on one side of the beam can be freed for rotation by retracting the pin out of the rotational path of the grippers.

The invention has been described with reference to the preferred embodiment. Obviously, modifications and alterations will be apparent to those of ordinary skill upon a reading and understanding of the specification. For example, the structural frame can adopt a variety of configurations that serve the same purpose as the angle bracket structure. Likewise, other biasing assemblies can be used to urge the grippers or the locking pin. The invention is intended to include all such modifications and alterations insofar as they come within the scope of the appended claims.

Having thus described the invention, it is now claimed:

1. An apparatus for either simultaneously grasping or simultaneously releasing a plurality of parallel spaced joist members to be lifted by an erection crane, the apparatus comprising:

an elongated structural beam having an attachment member for securing the structural beam to the erection crane;

a plurality of pairs of grasping members spaced along the structural beam and extending outwardly therefrom in a plane parallel to the elongated structural beam, each pair including first and second grasping members for grasping and releasing the parallel spaced joist members which are aligned perpendicular to the structural beams an assembly for simultaneously actuating the grasping members to one of grasping or releasing positions;

a biasing member operatively associated with the grasping members for urging the grasping members to one of the grasping and releasing positions.

2. The apparatus of claim 1 wherein the grasping members include hooks dimensioned for receipt about the joist members.

3. The apparatus of claim 1 wherein each grasping member is mounted to the structural beam for selective rotation about a pivot member between the grasping and releasing positions.

4. The apparatus of claim 1 wherein the first and second grasping members are generally J-shaped hooks having open regions, the open regions of the first and second J-shaped hooks being disposed in opposite directions.

5. The apparatus of claim 1 wherein the actuating assembly includes an elongated actuator member interconnecting the individual grasping members whereby movement of the actuator member simultaneously actuates or deactuates the grasping members.

6. The apparatus of claim 1 wherein the grasping members are adjustably mounted along the structural beam to accommodate different spacing between joist members.

7. The apparatus of claim 1 wherein the structural beam has first and second spaced attachment members for securing the structural beam to the erection crane.

8. An apparatus for either simultaneously grasping or simultaneously releasing a plurality of parallel spaced joist members to be lifted by an erection crane, the apparatus comprising:

an elongated structural beam having an attachment member for securing the structural beam to the erection crane;

a plurality of pairs of grasping members adjustably secured along the structural beam and extending outwardly therefrom in a plane parallel to the elongated structural beam, each pair including first and second grasping members for grasping and releasing the parallel spaced joist members which are aligned perpendicular to the structural beam;

an assembly for simultaneously actuating the grasping members to one of grasping or releasing positions; and a biasing member operatively associated with the grasping members for urging the grassing members to one of the grasping and releasing positions.

9. The apparatus of claim 8 wherein the grasping members are disposed on opposite sides of the structural beam and each grasping member includes a generally J-shaped hook having an open region dimensioned for receipt over the joist member.

10. The apparatus of claim 9 wherein the hook on opposite sides of the structural beam have the open regions facing in opposite directions.

11. The apparatus of claim 9 wherein the hooks are pivotally mounted to the structural beam for limited rotational movement about horizontal axes between the grasping and releasing positions.

12. The apparatus of claim 11 wherein each of the hooks includes an extending arm that engages the actuating assembly.

13. The apparatus of claim 8 wherein the grasping members include hooks dimensioned for receipt about the joist members.

14. The apparatus of claim 8 wherein each grasping member is mounted to the structural beam for selective rotation about a pivot member between the grasping and releasing positions.

15. The apparatus of claim 8 wherein the first and second grasping members are generally J-shaped hooks having open regions, the open regions of the first and second J-shaped hooks being disposed in opposite directions.

16. The apparatus of claim 8 wherein the structural beam has first and second spaced attachment members for securing the structural beam to the erection crane, the attachment members being infinitely adjustably mounted along the structural beam.

17. An apparatus for either simultaneously grasping or simultaneously releasing a plurality of parallel spaced joist members to be lifted by an erection crane, the apparatus comprising:

an elongated structural beam having an attachment ember for securing the structural beam to the erection crane;

a plurality of pairs of grasping members adjustably secured along the structural beam and extending outwardly therefrom in a plane parallel to the elongated structural beam, each pair including first and second grassing members for grasping and releasing the parallel spaced joist members which are aligned perpendicular to the structural beam:

an assembly for simultaneously actuating the grasping members to one of grasping or releasing positions, wherein the actuating assembly includes an elongated actuator member interconnecting the individual grasping members whereby movement of the actuator member simultaneously actuates or deactuates the grasping members.

* * * * *